US008117965B1

(12) United States Patent
Anthony et al.

(10) Patent No.: US 8,117,965 B1
(45) Date of Patent: Feb. 21, 2012

(54) HAND-HELD STAMP HAVING INTEGRAL DUST COVER

(75) Inventors: John J. Anthony, Downers Grove, IL (US); David M. Hines, Santa Ana, CA (US)

(73) Assignee: Cosco Industries, Inc., North Mankato, MN (US)

( * ) Notice: Subject to any disclaimer, the term of this patent is extended or adjusted under 35 U.S.C. 154(b) by 308 days.

(21) Appl. No.: 12/604,772

(22) Filed: Oct. 23, 2009

(51) Int. Cl.
*B41K 1/58* (2006.01)

(52) U.S. Cl. ..... 101/327; 101/405

(58) Field of Classification Search ..... 101/327, 101/333, 334, 405, 406; *B41K 1/58*
See application file for complete search history.

(56) References Cited

U.S. PATENT DOCUMENTS

| | | | | |
|---|---|---|---|---|
| 4,579,057 | A | 4/1986 | Hewitt et al. | |
| 5,105,738 | A * | 4/1992 | Mehaffey | 101/333 |
| 5,826,506 | A | 10/1998 | Lin | |
| 6,499,398 | B2 | 12/2002 | MacNeil | |
| 7,066,089 | B1 | 6/2006 | Shih | |
| D544,523 | S | 6/2007 | Bain et al. | |
| 7,334,521 | B2 | 2/2008 | Moody | |
| 2003/0047095 | A1 * | 3/2003 | Cho | 101/327 |

FOREIGN PATENT DOCUMENTS

JP 2009056715 A * 3/2009

OTHER PUBLICATIONS

Cosco Industries, Inc. prototype of packaging for "Accustamp 2 Premium 2-Color Shutter Stamp" illustrating commercial embodiment of invention first offered for sale Feb. 1, 2009.

* cited by examiner

*Primary Examiner* — Leslie J Evanisko
(74) *Attorney, Agent, or Firm* — Dicke, Billig & Czaja, PLLC

(57) ABSTRACT

A pre-inked hand-held stamp includes a pair of outwardly positioned dust cover doors that are opened by movement of the internal components of the stamp during use.

16 Claims, 6 Drawing Sheets

HAND-HELD STAMP HAVING INTEGRAL DUST COVER

TECHNICAL FIELD

This application concerns hand-held stamps of the type that employ a porous, inked material bearing an image.

BACKGROUND

Certain types of pre-inked hand stamp have dust cover doors at the working end of the stamp (i.e., the end which contacts the paper or other surface to be stamped). See, for example, U.S. Pat. No. 4,579,057 (Hewitt, et al.), which illustrates a stamper having a stamp element and a one-piece cover which rotates from a position in front of the element to a position 180° away, on the top of the stamper. U.S. Pat. No. 5,826,506 (Lin) illustrates a stamper in which a pair of rotating lids is provided and actuated by pins integral to the stamp body that slide within troughs formed in each lid.

Still others use removable or pivotally mounted covers that are actuated by hand as necessary. Removable covers, of course, are easily lost entirely, or are inconvenient to restore to closed position, especially if the stamper is being used frequently in a single sitting.

A commercially available product known by the trade name Clik! is depicted in U.S. Design Pat. 544,523 but is not known to be described in a utility patent. The product has a lever mounted to a first portion of the cover, which pivots away from another portion of the cover when finger pressure acts on the lever. The stamp pad is pivotally mounted within the interior of the stamper such that the first cover portion causes the pad to pivot into position for stamping. There is no spring in this stamper and thus the unit may be left in the open position, exposing the stamp pad to dust and inadvertent discharge of ink from the pad.

SUMMARY

A pre-inked hand-held stamp includes a cover in the form of a pair of exteriorly mounted, oppositely moving dust cover doors that are automatically opened and closed by the action of the stamping operation. This allows for one-step, one-handed operation while retaining the usefulness of a dust cover that is attached to the stamp and cannot be misplaced.

In a preferred embodiment, the pre-inked hand-held stamp comprises a stamp body and a sub-assembly comprising a stamp die and two ends. The sub-assembly is reversibly movable between a first position fully within the interior of the stamp body, and a second position in which the exposed, inked face of the stamp die slightly extends beyond the stamp body to be presented to or otherwise address the workpiece. The stamp also comprises a pair of dust cover doors, each pivotably mounted to the exterior of the stamp body by inwardly directed pins integral to the dust cover doors. Movement of the subassembly toward the workpiece outside the stamp body engages the pins to pivot the dust cover doors open, enabling the subassembly to emerge from within the stamp body and deliver ink to the workpiece.

It is possible for the sub-assembly to withdraw back into the interior of the stamp body and allow gravity or another mechanism (e.g., auxiliary springs) to return the dust cover doors back to their original position. However, in the preferred embodiment, the inwardly directed pins are also engaged by the reversed movement of the subassembly to draw the dust cover doors closed as the subassembly retreats into the interior of the stamp body.

BRIEF DESCRIPTION OF THE DRAWINGS

The accompanying figures show a particular preferred embodiment as an example, but such illustration is not intended to limit the scope of the claims. In particular, the proportions and/or dimensions that may be shown in, or suggested by, the figures are preferred but not required except as specifically set forth in the claims.

DETAILED DESCRIPTION

In general terms, several types of pre-inked hand-held stamps (or stampers) are known commercially. Therefore, conventional details of construction and operation of components not specific to the claims are not recited below, but are within the skill in the art. In particular, various components may fit together as depicted in the figures even if such fitting is not specifically described below.

Figure 5:
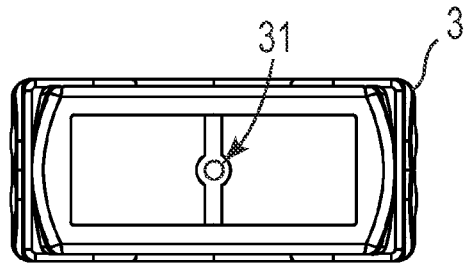
FIG. 5 is a top view of a component of the same embodiment.
Figure 6:
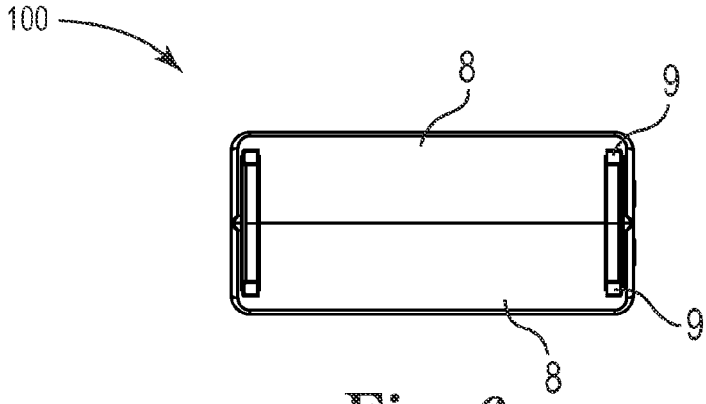
FIG. 6 is a bottom view of the same embodiment with the dust cover doors closed.
Figure 7:
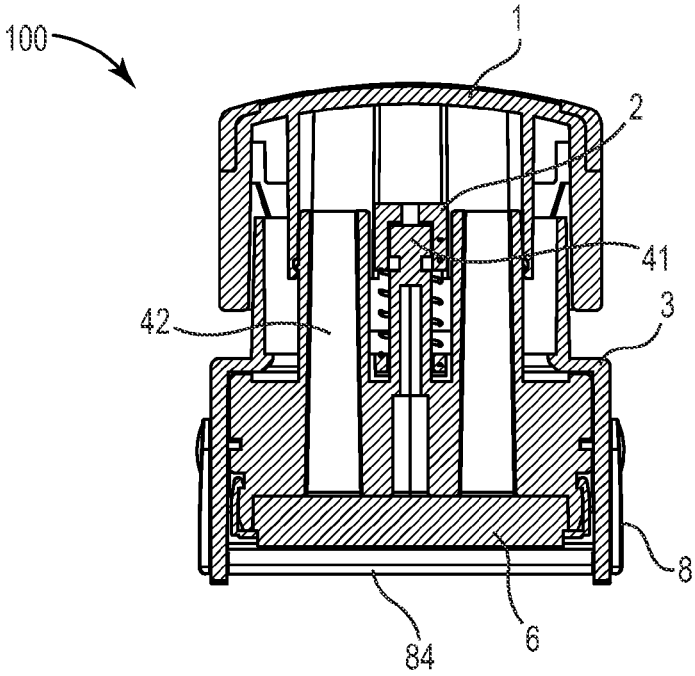
FIG. 7 is a cross-sectional front view taken along the lines 7-7 of FIG. 4.
Figure 8:
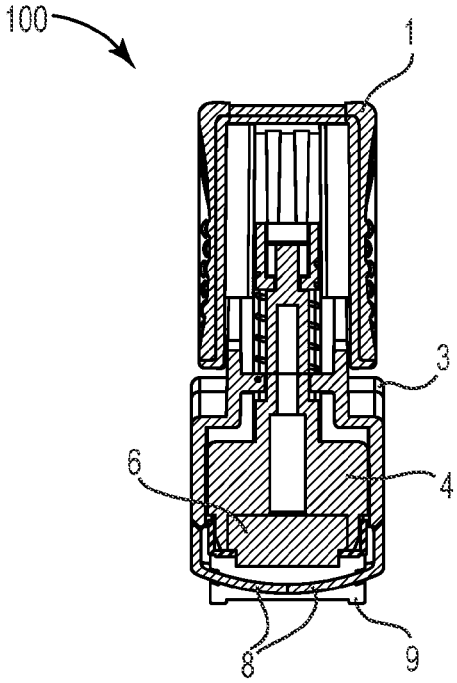
FIG. 8 is a cross-sectional end view taken along the lines 8-8 of FIG. 1.

Referring to the Figures, the preferred embodiment of a pre-inked hand stamp indicated as 100 comprises a handle 1 which snaps onto a sub-assembly known in the art as chimney 4, while ferrule 2 attaches onto the shaft 41 of chimney 4, the latter passing though an opening 31 in the interior of stamp body 3 (see FIG. 5). The extent of downward travel of handle 1, and thus of chimney 4, relative to stamp body 3 may be limited by the extent to which ferrule 2 may travel before internally contacting stamp body 3, or by the handle contacting the body, as known in the art. A spring 11 between ferrule 2 and stamp body 3 is compressed by the downward travel of ferrule 2, thus providing sufficient spring force to return handle 1 to its initial position when released. As explained in greater detail below, downward movement of chimney 4 also moves dust cover doors 8 outwardly to expose stamp die 6 at the bottom of chimney 4 so that it may strike the workpiece (paper or other surface) outside the interior of the stamp body. In this embodiment, upward movement of handle 1 moves dust cover doors 8 inwardly to close the bottom of stamp 100 and thus protect stamp die 6 from dust when it is not exposed. During this reversible movement of chimney 4 within stamp body 3 that causes dust cover doors 8 to swing open, support feet 9 (typical of two illustrated) formed in body 3 are stationary against the workpiece. Stamp die 6 (which may be a collection of materials as well known in the art) is held in place by retainer 7, which clips onto chimney 4 and has an open area that exposes the bottom face of stamp die 6 to the workpiece. Stamp die 6 may be supplied in a pre-inked condition, preferably pre-installed within chimney 4, or may have ink added to it according to known techniques by removing handle 1 and dispensing ink into either of the open columns 42 of chimney 4.

Figure 9:
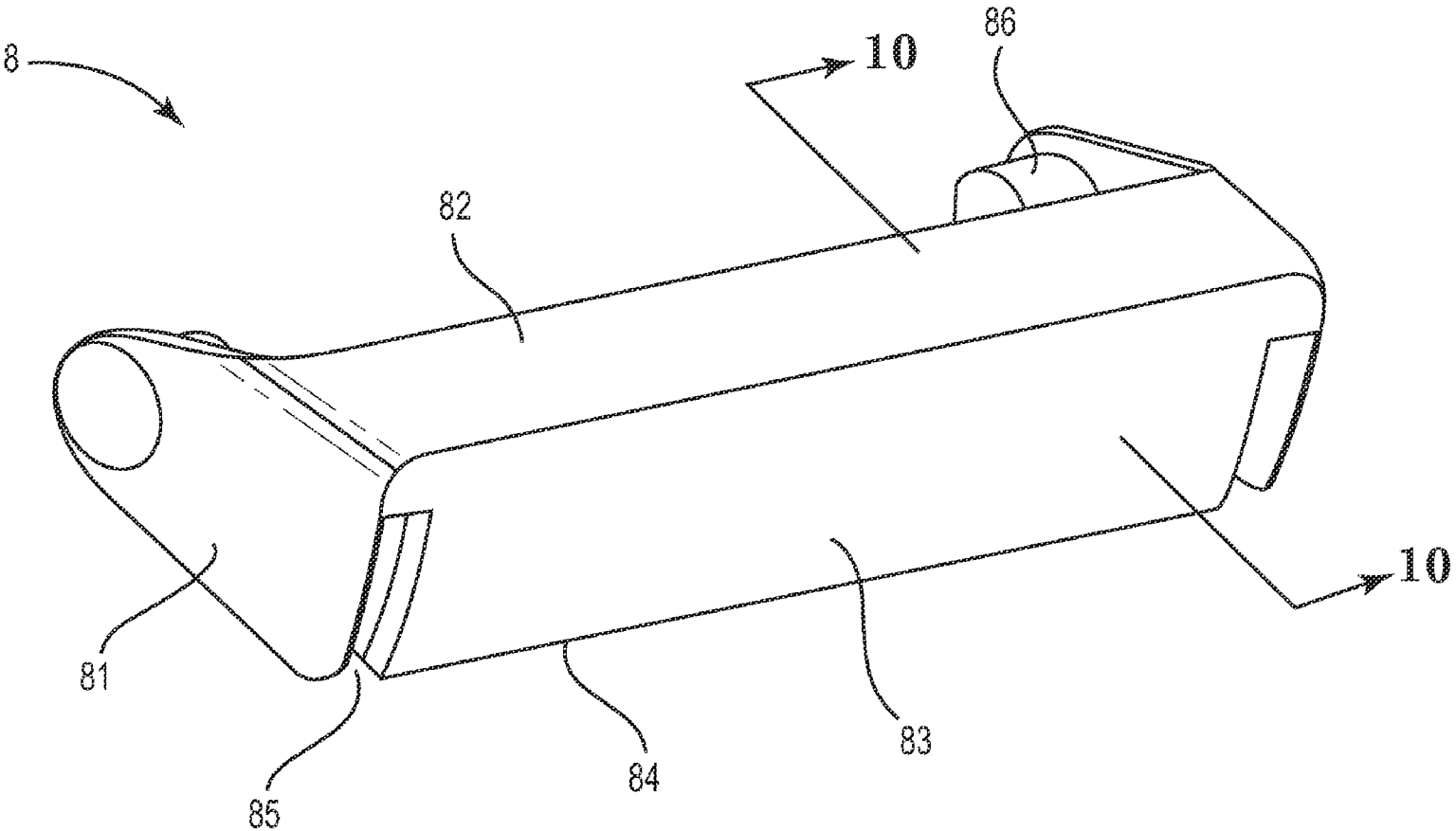
FIG. 9 is a perspective view of the dust cover door component of the illustrated embodiment.
Figure 11:
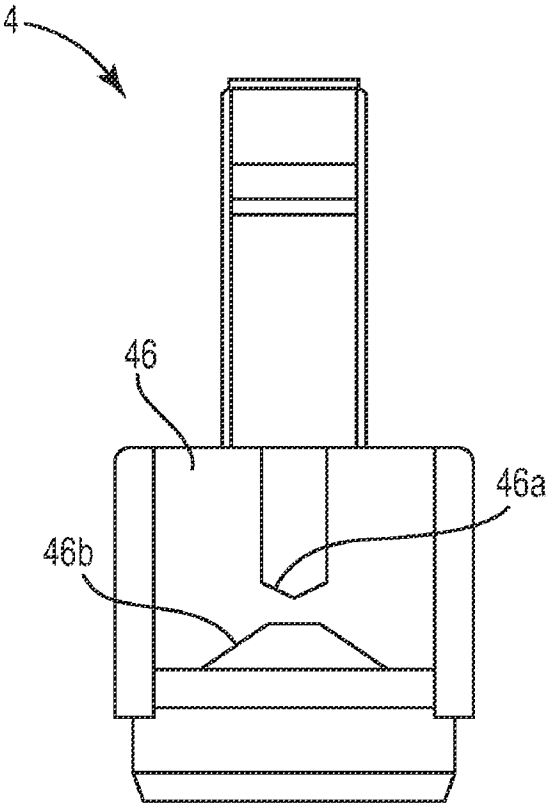
FIG. 11 is an end view of the chimney component of the illustrated embodiment.
Figure 10:
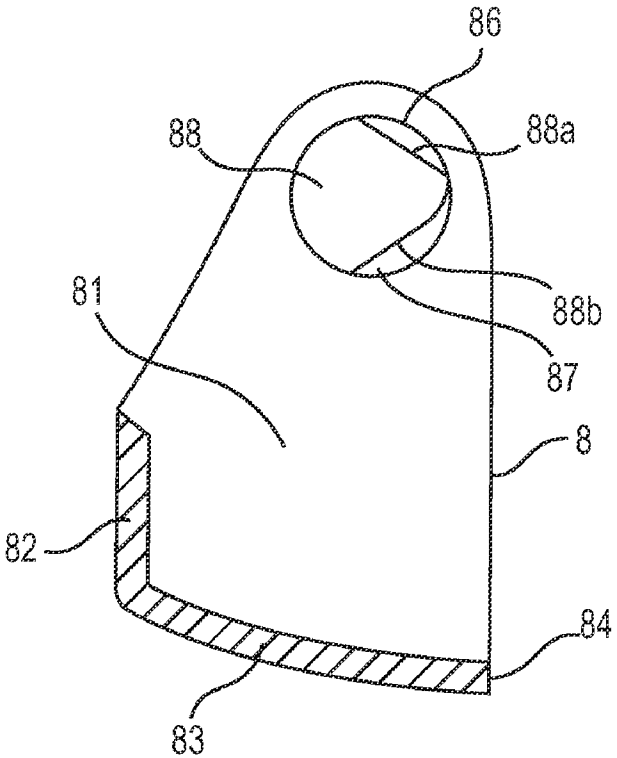
FIG. 10 is a cross-sectional end view taken along the lines 10-10 of FIG. 9.

Turning to FIGS. 9-11, each dust cover door 8 comprises first and second ends 81 that lie on opposite ends of dust cover door 8 and are connected to each other by a generally planar side 82 that is mutually perpendicular to each end 81; first and second ends 81 are further connected to each other by a generally planar door face 83. The door face 83 has an edge 84 mating with its counterpart on the other door face 83 when the two dust cover doors 8 are in the closed position. Each of two slots 85 formed in the door face 83 enables the two door faces 83 to fully close together above the plane of the work surface. This is assisted by small notches 32 that are formed at corresponding locations of each end 35 of the stamp body 3 (see also FIG. 3). The notches 32 allow the dust cover doors 8 to fully close together yet provide for each side section 82 to lie flush with the side 35 of stamp body 3 when the dust cover door 8 is in the closed position (see also FIG. 4).

Figure 3:
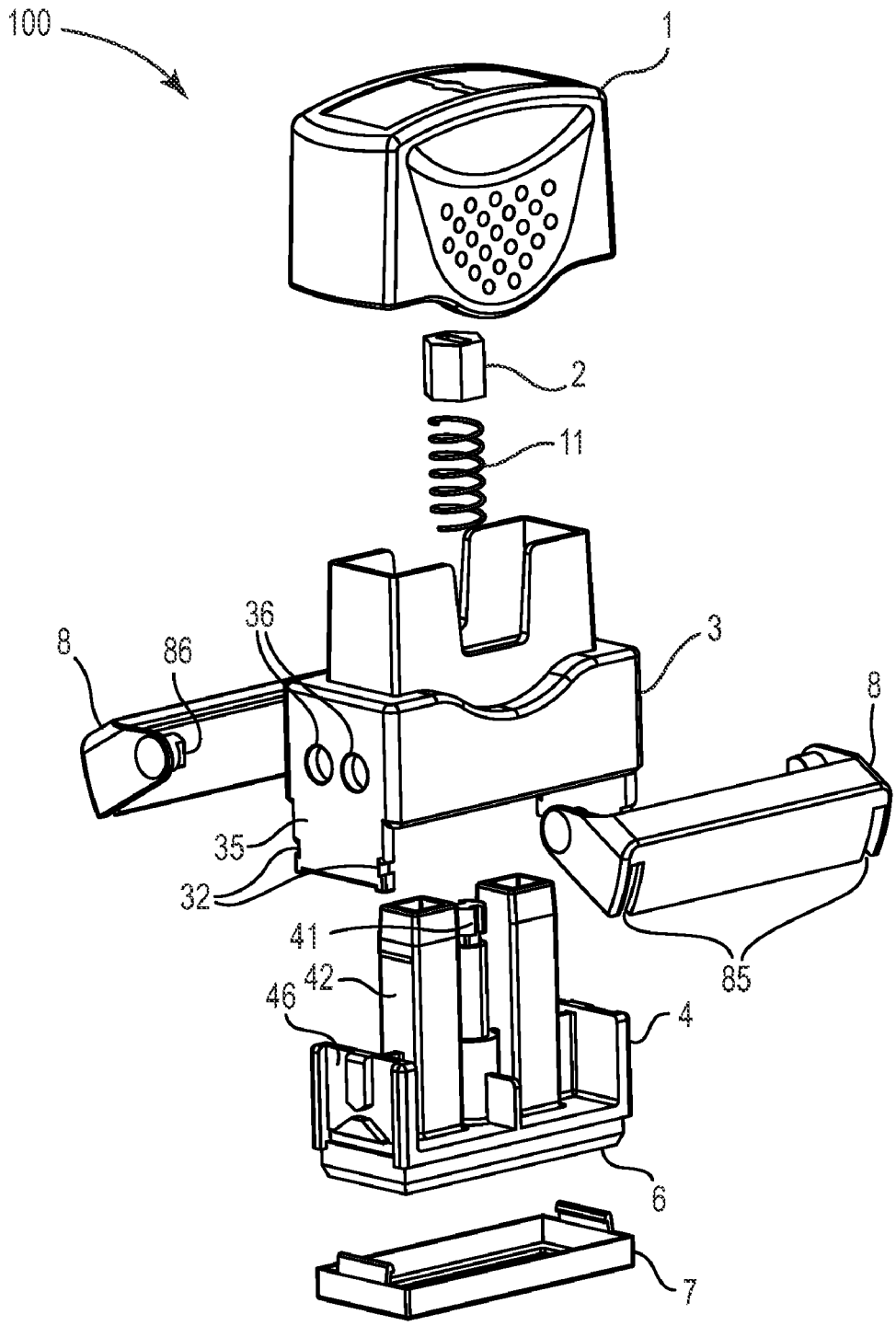
FIG. 3 is an exploded perspective view of the same embodiment.
Figure 4:
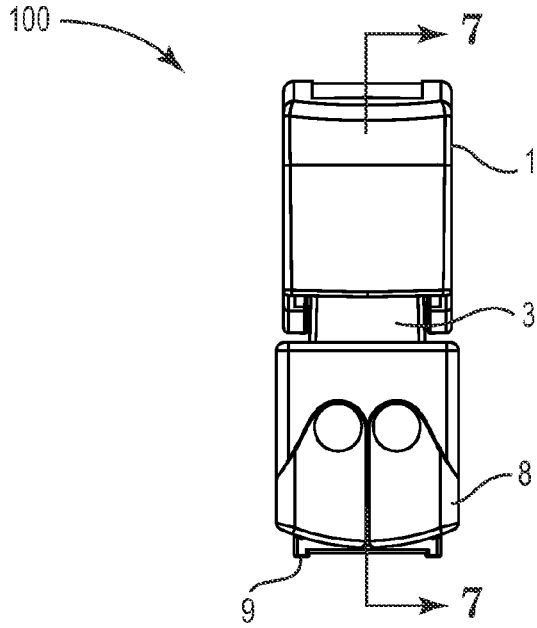
FIG. 4 is an assembled end view of the same embodiment.

Each end section 81 has an inwardly-directed hinge pin 86 which fits within a corresponding circular opening 36 in the side 35 of stamp body 3 (see also FIG. 3). Each hinge pin 86 has a cylindrical base 87 lying in the circular opening 36 and, extending further inwardly from cylindrical base 87, a wedge 88. The outer (i.e., toward the side of the stamp) directed wedge face 88*a* of wedge 88 mates with feature 46*a* defined in channel 46 of chimney 4 (see also FIG. 4), so that downward motion of the latter pivots dust cover door 8 outwardly, i.e., from closed to open. In this manner, pressing the handle downward opens the dust cover doors 8 to allow the chimney 4 (and thus the stamp pad 6) to pass though the open lower end of the stamp body 3 and toward the work surface.

Figure 1:
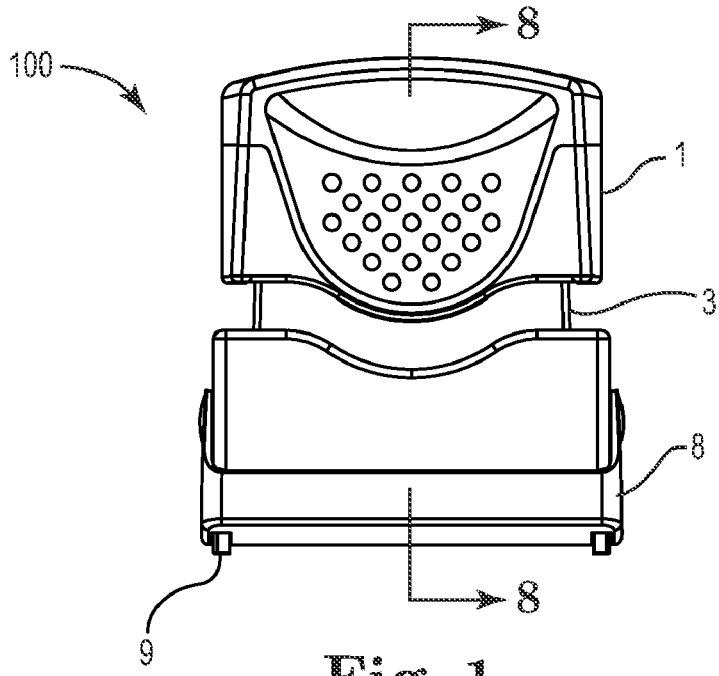
FIG. 1 is a front assembled view of a preferred embodiment.
Figure 2:
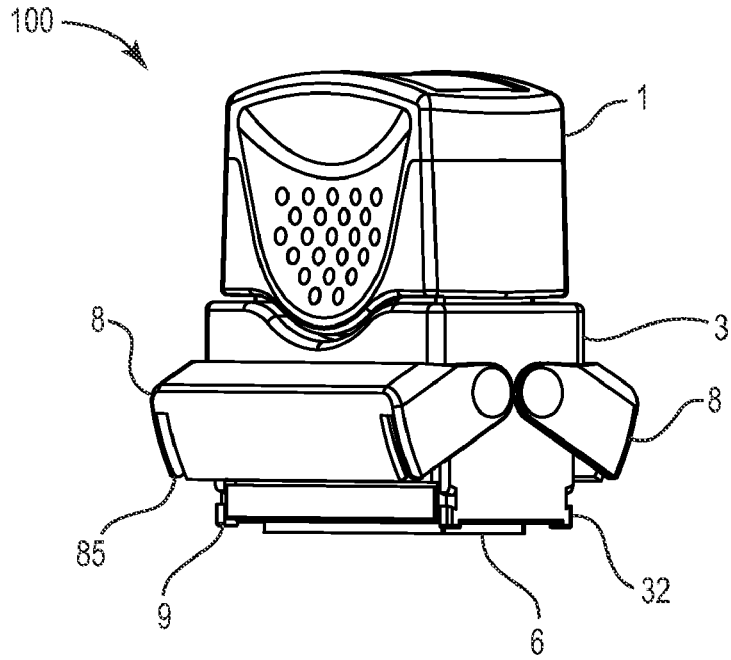
FIG. 2 is a perspective view of the same embodiment in use.

In this preferred embodiment, when spring 11 returns the handle 1 and chimney 4 upward, the other feature 46*b* on the chimney 4 engages the inwardly-directed wedge face 88*b* of the wedge 88 to move the dust cover doors 8 back to the closed position. They remain closed by the force provided by the spring 11, which holds the handle 1 and chimney 4 in the upright position. In this manner, dust cover doors 8 remain closed even if the entire stamp unit 100 is inverted. However, in other embodiments, gravity or another mechanism (e.g., auxiliary springs) (not illustrated) may return the dust cover doors 8 back to their original position, at least when stamp 100 is oriented upright as illustrated in at least FIGS. 1 and 2. In such cases, feature 46*b* and wedge face 88*b* may be omitted or modified as required.

Returning to the preferred embodiment illustrated, wedge faces 88*a* and 88*b* form an angle of approximately 63° between themselves, although this value will also depend on the dimensions and shapes of features 46*a* and 46*b*, which mate with wedge faces 88*a* and 88*b*. The vertex of the angle between wedge faces 88*a* and 88*b* is preferably beveled as required for smooth operation.

The stamp 100 is preferred to have symmetrical construction as illustrated in the Figures, such that each dust cover door 8 is identical to each other (as are the two ends of chimney 4, i.e., channel 46 and features 46*a* and 46*b*). Thus, they may be interchanged with each other. This is only a preference and not a requirement. It is possible for hinge pins 86 (and the features of the same) to mate with corresponding but non-identical channels, if it is desired to have non-identical doors or identical doors which may be mounted to stamp body 3 in only one orientation.

Many of the specific details of the components described in this application are dictated to large degree by the design and engineering of the preferred embodiment illustrated. However, such details are not necessarily required in the broadest embodiment enabled by this application. Similarly, alternative constructions that achieve the same functions as the components and features described in this application are within the scope of the broadest embodiment, unless specifically excluded by the following claims.

We claim:

1. A pre-inked hand-held stamp, comprising:

a stamp body defining an interior and an exterior;

a subassembly having two ends and comprising a stamp die at one of the two ends, the subassembly being reversibly movable in the interior of the stamp body; and a pair of dust cover doors, each mounted to the exterior of the stamp body by inwardly directed pins integral to each dust cover door, the pins engaging the subassembly such that movement of the subassembly toward a workpiece exterior to the stamp body pivots the dust cover doors open, enabling the subassembly to emerge from the interior of the stamp body.

2. The stamp of claim 1, in which each dust cover door comprises first and second end sections on opposite ends of each dust cover door, a generally planar side section, and a generally planar door face having an edge for mating to a counterpart dust cover door when closed.

3. The stamp of claim 1, in which the stamp body comprises notches to allow the dust cover doors to fully close together while lying flush with a side of stamp body in the closed position when the subassembly is fully within the stamp body.

4. The stamp of claim 1, in which the inwardly directed pins comprise a pair of inwardly-directed hinge pins provided on each dust cover door, each pin fitting within a corresponding opening in a side of the stamp body.

5. The stamp of claim 4, in which each hinge pin comprises a cylindrical base lying in the opening and a wedge extending further inwardly from the cylindrical base, each wedge having outer and inner directed faces which mate with features defined in the movable subassembly.

6. The stamp of claim 1, in which each dust cover door is identical to each other.

7. The stamp of claim 1, in which the subassembly comprises a pair of end faces, each end face defining a channel, a ridge lying centrally in the channel and having a first pointed end facing but not contacting a second pointed end of the channel.

8. The stamp of claim 7, in which the inwardly directed pins comprise a pair of hinge pins provided on each dust cover door, each pin extending into the channel adjacent the first pointed end of the ridge and the second pointed end of the channel such that movement of the subassembly engages the faces of the hinge pins to rotate the dust cover door.

9. The stamp of claim 1, in which movement of the subassembly away from the workpiece engages the inwardly directed pins to close the dust cover doors as the subassembly retreats within the stamp body.

10. A pre-inked hand-held stamp, comprising a stamp body defining an interior and an exterior, a stamp die movable between the interior and the exterior of the stamp body, and a set of pivotably openable dust cover doors mounted to the exterior of the stamp body; in which each dust cover door comprises inwardly directed pins engaged by movement of the stamp die to pivot open to present the stamp die to the exterior of the stamp body.

11. The stamp of claim 10, in which each pin comprises a cylindrical base lying in an opening in a side of the stamp body and a wedge extending further inwardly from the cylindrical base.

12. The stamp of claim 11, in which each wedge comprises at least one face which mates with a feature defined on the movable subassembly.

13. The stamp of claim 12, in which each wedge comprises outer and inner directed faces each of which mate with features separately defined on the movable subassembly.

14. The stamp of claim 10, further comprising a subassembly having two ends, in which the stamp die lies at one of the two ends, the subassembly being reversibly movable in the interior of the stamp body.

15. The stamp of claim 14, in which movement of the subassembly away from the exterior engages the inwardly directed pins to close the dust cover doors as the subassembly retreats within the stamp body.

16. The stamp of claim 10, in which the stamp body comprises notches to allow the dust cover doors to fully close together while lying flush with a side of stamp body in the closed position.

* * * * *